US008684109B2

(12) United States Patent
Orbell et al.

(10) Patent No.: US 8,684,109 B2
(45) Date of Patent: Apr. 1, 2014

(54) DRILLING METHOD FOR DRILLING A SUBTERRANEAN BOREHOLE

(75) Inventors: Charles Orbell, Melbourne Beach, FL (US); Pat Savage, Queensland (AU)

(73) Assignee: Managed Pressure Operations Pte Ltd, Singapore (SG)

( * ) Notice: Subject to any disclaimer, the term of this patent is extended or adjusted under 35 U.S.C. 154(b) by 272 days.

(21) Appl. No.: 13/223,676

(22) Filed: Sep. 1, 2011

(65) Prior Publication Data

US 2012/0118638 A1 May 17, 2012

Related U.S. Application Data

(60) Provisional application No. 61/414,248, filed on Nov. 16, 2010.

(51) Int. Cl.
*E21B 21/08* (2006.01)

(52) U.S. Cl.
USPC ..... 175/48; 175/25; 175/38

(58) Field of Classification Search
USPC ..... 175/25, 38, 48
See application file for complete search history.

(56) References Cited

U.S. PATENT DOCUMENTS

| | | | |
|---|---|---|---|
| 704,423 | A | 7/1902 | Allen |
| 1,491,986 | A | 4/1924 | Greene |
| 2,102,555 | A | 12/1937 | Dyer |
| 2,158,356 | A | 5/1939 | Dyer |
| 3,298,385 | A | 1/1967 | Jackson et al. |
| 3,338,319 | A | 8/1967 | Griffin, III |
| 3,470,971 | A | 10/1969 | Dower |
| 4,448,267 | A | 5/1984 | Crawford, III et al. |
| 4,630,675 | A | 12/1986 | Neipling et al. |
| 4,685,520 | A | 8/1987 | McDaniel et al. |
| 4,770,389 | A | 9/1988 | Bodine et al. |
| 4,823,877 | A | 4/1989 | McDaniel et al. |
| 4,867,254 | A | 9/1989 | Gavignet |
| 5,070,949 | A | 12/1991 | Gavignet |
| 5,080,182 | A | 1/1992 | Thompson |

(Continued)

FOREIGN PATENT DOCUMENTS

| | | |
|---|---|---|
| EP | 1227215 B1 | 7/2002 |
| EP | 1248065 A2 | 10/2002 |

(Continued)

OTHER PUBLICATIONS

Co-pending U.S. Appl. No. 12/882,344, filed Sep. 15, 2010.

(Continued)

*Primary Examiner* — William P Neuder
(74) *Attorney, Agent, or Firm* — Bracewell & Giuliani LLP

(57) ABSTRACT

A method of drilling a subterranean borehole comprising:
a) pumping a drilling fluid down a drillstring (12), the drillstring (12) having a bit (14) at an end thereof,
b) rotating the drillstring (12) about its longitudinal axis so that the bit forms a borehole (10) in the ground,
the method further comprising the steps of:
c) determining a desired drilling fluid flow rate range
d) determining the desired upper and lower limits of the fluid pressure at the bottom of the wellbore (the BHP);
e) determining the viscosity of drilling fluid which will maintain the BHP within the range set by the upper and lower BHP limits over the entire or the majority of the required drilling flow rate range;
f) adjusting the composition of a drilling fluid to bring the drilling fluid to the viscosity calculated in step e above.

12 Claims, 4 Drawing Sheets

(56) References Cited

U.S. PATENT DOCUMENTS

| | | | | |
|---|---|---|---|---|
| 5,115,871 | A | 5/1992 | McCann et al. | |
| 5,431,188 | A | 7/1995 | Cove | |
| 5,628,493 | A | 5/1997 | McKnight et al. | |
| 5,975,219 | A | 11/1999 | Sprehe | |
| 6,176,323 | B1 | 1/2001 | Weirich et al. | |
| 6,244,631 | B1 | 6/2001 | Payne et al. | |
| 6,315,051 | B1 | 11/2001 | Ayling | |
| 6,374,925 | B1 | 4/2002 | Elkins et al. | |
| 6,527,062 | B2 | 3/2003 | Elkins et al. | |
| 6,814,142 | B2 | 11/2004 | Paulk et al. | |
| 6,904,981 | B2 | 6/2005 | van Riet | |
| 7,044,237 | B2 | 5/2006 | Leuchtenberg | |
| 7,107,875 | B2 | 9/2006 | Haugen et al. | |
| 7,185,719 | B2 | 3/2007 | van Riet | |
| 7,395,878 | B2 | 7/2008 | Reitsma et al. | |
| 7,836,973 | B2 * | 11/2010 | Belcher et al. | 175/25 |
| 7,984,770 | B2 * | 7/2011 | Sehsah | 175/48 |
| 8,122,975 | B2 * | 2/2012 | Belcher et al. | 175/57 |
| 2003/0079912 | A1 | 5/2003 | Leuchtenberg | |
| 2003/0168258 | A1 | 9/2003 | Koederitz | |
| 2005/0092523 | A1 | 5/2005 | McCaskill et al. | |
| 2006/0060360 | A1 | 3/2006 | Moncus et al. | |
| 2006/0124352 | A1 | 6/2006 | Krueger et al. | |
| 2006/0157282 | A1 | 7/2006 | Tilton | |
| 2006/0254822 | A1 | 11/2006 | Ayling | |
| 2006/0278434 | A1 | 12/2006 | Calderoni et al. | |
| 2007/0151762 | A1 | 7/2007 | Reitsma | |
| 2007/0231158 | A1 | 10/2007 | Butler et al. | |
| 2008/0105434 | A1 | 5/2008 | Orbell et al. | |
| 2009/0025930 | A1 | 1/2009 | Iblings et al. | |
| 2009/0242817 | A1 | 10/2009 | Strazhgorodskiy | |

FOREIGN PATENT DOCUMENTS

| | | | |
|---|---|---|---|
| EP | 1048819 | B1 | 2/2004 |
| EP | 1754947 | A2 | 2/2007 |
| GB | 2119046 | A | 11/1983 |
| GB | 2290330 | A | 12/1995 |
| GB | 2314106 | A | 12/1997 |
| GB | 2427217 | B | 10/2008 |
| GB | 2451699 | A | 2/2009 |
| JP | 2007174548 | A | 7/2007 |
| WO | GB2354783 | | 4/2001 |
| WO | WO 0236928 | A1 | 5/2002 |
| WO | WO0250398 | | 6/2002 |
| WO | WO 2004074627 | A1 | 9/2004 |
| WO | WO 2005019596 | A1 | 3/2005 |
| WO | WO 2005080745 | A1 | 9/2005 |
| WO | WO 2007005822 | A2 | 1/2007 |
| WO | 2007081711 | A2 | 7/2007 |
| WO | WO 2007124330 | A2 | 11/2007 |
| WO | WO 2008051978 | A1 | 5/2008 |
| WO | WO 2008095650 | A1 | 8/2008 |
| WO | WO 2008156376 | A1 | 12/2008 |
| WO | WO 2009018173 | A2 | 2/2009 |
| WO | WO 2009022914 | A1 | 2/2009 |
| WO | WO 2010046653 | A2 | 4/2010 |

OTHER PUBLICATIONS

Co-pending U.S. Appl. No. 113/262,595, filed Sep. 30, 2011.

Tian et al., "Parametric Analysis of MPD Hydraulics", IADC/SPE International 108354-PP, Mar. 28, 2007, 7 pgs., Galveston, Texas.

GB International Search Report for GB0905633.4, Aug. 10, 2009, 1 page.

Adri Schouten, PCT International Search Report for PCT/EP2010/054387, Sep. 23, 2010, 2 pages.

Skalle, Pal, "Trends Extracted From 800 Gulf Coast Blowouts During 1960-1996" Society of Petroleum Engineers, IADC/SPE 39354, 1998 IADC/SPE Drilling Conference held in Dallas, Texas, Mar. 3-6, 1998, pp. 539-546.

Schubert, J.A. and Wright, J.C., "Early Kick Detection Through Liquid Level Monitoring in the Wellbore" Society of Petroleum Engineers, IADC/SPE 39400, 1998 IADC/SPE Drilling Conference held in Dallas, TX, Mar. 3-6, 1998, pp. 889-895, Copyright 1998, IADC/SPE Drilling Conference.

Hutchinson, M., Rezmer-Cooper, A and L. and Schlumberger, "Using Downhole Annular Pressure Measurements to Anticipate Drilling Problems" Society of Petroleum Engineers, SPE 49114, 1998 SPE Annual Technical Conference and Exhibition held in New Orleans, LA, Sep. 27-30, 1998, pp. 535-549, Copyright 1998, Society of IADC/SPE Drilling Conference.

PCT International Search Report, dated Nov. 3, 2010, International Application No. PCT/EP2010/063579; filed Sep. 15, 2010.

GB International Search Report for GB0905802.6, Jul. 31, 2009, 2 pages.

Stephane Ott, PCT International Search Report for PCT/GB2010/050571, Dec. 17, 2010, 2 pages.

International Search Report issued in PCT/GB2011/052234 on May 8, 2013.

* cited by examiner

DRILLING METHOD FOR DRILLING A SUBTERRANEAN BOREHOLE

RELATED APPLICATIONS

This application claims priority to U.S. Provisional Patent Application Ser. No. 61/414,248 filed on Nov. 16, 2010, which is incorporated by reference in its entirety.

FIELD OF THE INVENTION

The present invention relates to a method of drilling a subterranean borehole.

DESCRIPTION OF THE PRIOR ART AND BACKGROUND TO THE INVENTION

Subterranean drilling of a bore hole or wellbore typically involves rotating a drill bit from surface or on a downhole motor at the remote end of a tubular drill string. It involves pumping a fluid down the inside of the tubular drillstring, through the drill bit, and circulating this fluid continuously back to surface via the drilled space between the hole/tubular, referred to as the annulus. This pumping mechanism is provided by positive displacement pumps that are connected to a manifold which connects to the drillstring, and the rate of flow into the drillstring depends on the speed of these pumps. The drillstring is comprised of sections of tubular joints connected end to end, and their respective outside diameter depends on the geometry of the hole being drilled and their effect on fluid hydraulics in the annulus.

The entire drillstring and bit are rotated using a rotary table, or using an above ground motor mounted on the top of the drill pipe known as a top drive. The bit can also be turned independently of the drillstring by a drilling fluid powered downhole motor, integrated into the drillstring just above the bit. Therefore speed of operation of the bit can vary with either the speed of the surface rotary mechanism or by the rate of pumping of drilling fluid through the downhole motor.

The bit is the apparatus which provides the necessary crushing/cutting action to penetrate the rock layers as the wellbore is drilled deeper, and it is used in combination with the weight provided by the entire drillstring that exists above it to provide the necessary force to penetrate the rock layers. Bit types vary and have different designs in their profile in regards to items such as cutter design and profile and are predominantly selected based on the formation type being drilled.

The bit penetrates its way through layers of underground formations until it reaches target prospects—rocks which contain hydrocarbons at a given temperature and pressure. These hydrocarbons are contained within the pore space of the rock (i.e. the void space) and can contain water, oil, and gas constituents—referred to as reservoirs. Due to overburden forces from layers of rock above, these reservoir fluids are contained and trapped within the pore space at a known or unknown pressure, referred to as pore pressure.

A fluid of a given density fills and circulates the annulus of the drilled hole. The purpose of this drilling fluid/mud is to lubricate, carry drilled rock cuttings to surface, cool the drill bit, and power the downhole motor and other tools. Mud is a very broad term and in this context it is used to describe any fluid or fluid mixture that covers a broad spectrum from air, nitrogen, misted fluids in air or nitrogen, foamed fluids with air or nitrogen, aerated or nitrified fluids, to heavily weighted mixtures of oil and water with solids particles. Most importantly this fluid and its resulting hydrostatic pressure—the pressure that it exerts at the bottom of the hole from its given density—prevent the reservoir fluids at their existing pore pressure from entering the drilled annulus. The drilling fluid must also exert a pressure less than the fracture pressure of the formation, which is where fluid will be forced into the rock as a result of pressure in the wellbore exceeding the formation's horizontal stress forces.

The bottom hole pressure (BHP) exerted by the hydrostatic pressure of the drilling fluid is the primary barrier for preventing influx from the formation. BHP can be expressed in terms of static BHP or dynamic/circulating BHP. Static BHP relates to the BHP value when the mud pumps are not in operation. Dynamic or circulating BHP refers to the BHP value when the pumps are in operation during drilling or circulating. It is the density property of the drilling fluid system that is primarily used for controlling the BHP so an influx event does not occur. Conventional methods use the density of the drilling fluid to control a point pressure in the wellbore, for example at the bottom of the hole (BHP), and are not used for pressure control along the entire length of the wellbore.

If the formation enters the well bore, this is referred to as a kick or influx. If the drilling fluid enters the rock, this is referred to as lost circulation or losses. Therefore the goal of a conventional drilling system is to maintain the BHP above the pore pressure but below the fracture pressure. The management of BHP to stay above the pore pressure and below the fracture pressure can be referred to as managed pressure drilling (MPD) or equivalent circulating density (ECD) management.

Equivalent circulating density (ECD) is the increase in bottom hole pressure (BHP) expressed as an increase in pressure that occurs only when drilling fluid is being circulated. This pressure is different to the hydrostatic pressure as the ECD calculation and value reflect the total friction losses in the annulus from the point of fluid exiting the bit at the wellbore bottom to surface as it flows up the annulus. The ECD can result in a bottom hole pressure that varies from being slightly to significantly higher than the bottom hole pressure when the drilling fluid is not being pumped through the system. The ECD is related to the circulating or drilling BHP in the sense that the ECD is calculated from the BHP. The ECD is directly related to the friction losses that are occurring along the entire length of the wellbore.

At the bottom of the tubular drillstring, downhole measuring devices are integrated into the drillstring above the downhole motor and bit. This allows the drilled hole to be steered in the appropriate direction to reach the reservoir target. Two important parameters measured downhole with these tools are the BHP and the bottom hole temperature (BHT) during drilling, circulating, static periods, and when pipe is removed or run into the wellbore. The measurement of BHP can be used to calculate the corresponding ECD. The measurement of BHT facilitates the temperature profiling over the entire wellbore length.

Therefore, the drilling fluid is pumped through the inside of the drillstring via a hose connected to the top of the drillstring, the hose injecting drilling fluid into the main internal bore of the drillstring. The fluid circulates down the entire internal length of the drillstring, through the bit, and returns to surface via the annulus. It carries with it drilled formation solids and keeps the drilled hole clean, thus substantially preventing a stuck bit or stuck pipe scenario as more solids enter the annulus from drilling.

Friction losses create pressure losses along the fluid's flow path in the annulus, so significant pressure is required to move the mud along its flow path. The friction losses occur between the fluid and the contact surfaces of the well bore and drill pipe. Some of the factors affecting friction losses are the geometry of the drillstring relative to the wellbore and the resultant annular clearance, fluid properties such as viscosity, fluid flow rate, and drillstring rotation RPM. It takes one or more positive displacement pumps to push the mud through the system at a suitable rate to ensure that the mud will effectively move solids, clean the hole, and power the bit while drilling. As the mud flows up the annulus, the greatest pressure is generated at the bottom of the hole from the summation of all the frictional losses occurring along the entire wellbore length.

The ECD and BHP are affected by the density of the drilling fluid, which is a variable that is controlled by use of additives in the drilling fluid. Such additives are well known in the art. A virgin or base fluid for a drilling fluid system with no additives has a specific density—by increasing the solids content in this fluid its density is increased. By diluting or decreasing the solids content in a drilling fluid its density is decreased. Both of these conditions are altered through mixing processes which occur at surface in the drilling fluid mud tanks and storage system. The density of a fluid is directly proportional to the hydrostatic pressure it exerts—a higher density fluid creates a higher hydrostatic pressure and vice versa.

Additional pressure effects can be imposed on the BHP with a closed loop system, such as the case with managed pressure drilling or underbalanced drilling. In these systems, flow is diverted by a device that seals around the tubular drillstring at surface, referred to as a rotating head, which diverts the return fluid flow via a pipe conduit, referred to as a flow line. The seal isolates the wellbore below from the atmosphere and provides pressure integrity to the system. The flow then passes through a choking mechanism known as a choke or control valve. By opening or closing the choke or control valve, back pressure is imposed on the total system the flowing return stream and annular volume, which increases or decreases the BHP.

Conventional practices for drilling fluid system design use careful selection of the density of the fluid and/or applied surface pressure through a choke valve as the primary control(s) for BHP during drilling, circulation and connections. The density and/or choke components are point pressure controls, however, and do not control the pressure/ECD along the entire wellbore length.

DESCRIPTION OF THE INVENTION

According to a first aspect of the invention we provide a method of drilling a subterranean borehole comprising:

a) pumping a drilling fluid into an uppermost end of a drillstring, the drillstring having a bit at an end thereof,
b) rotating the drillstring about its longitudinal axis so that the bit forms a borehole in the ground, the method further comprising the steps of:

c) determining a desired drilling fluid flow rate range
d) determining the desired upper and lower limits of the fluid pressure at the bottom of the wellbore (the BHP);
e) determining the viscosity of drilling fluid which will maintain the BHP within the range set by the upper and lower BHP limits over the entire or the majority of the required drilling flow rate range;
f) adjusting the composition of a drilling fluid to bring the drilling fluid to the viscosity calculated in step e above.

Steps c, d, e and f may be carried out prior to steps a and b (i.e. before drilling has commenced).

The desired drilling fluid flow rate range may be determined by establishing the flow rate required to achieve effective removal of cuttings and any other solid debris from the wellbore. The drillstring may be provided with a fluid operated motor which is operable to cause rotation of the bit, and in this case the minimum fluid flow rate to operate the motor and/or the maximum flow rate tolerated by the motor may be considered when determining the desired drilling fluid flow rate range.

Viscosity is defined as the resistance of a fluid to flow, the resistance resulting from shear forces/stresses existing between the fluid and the surfaces in contact with the flow (drillpipe and the wellbore/casing walls). Viscosity varies with temperature and pressure—increasing temperatures generally decreases viscosity and vice versa, whilst increasing pressure increases viscosity and vice versa.

In drilling operations, drilling fluids behave with non-Newtonian fluid flow property—a fluid whose flow properties are not described by a single constant value of viscosity. This is because with Non-Newtonian fluids viscosity is not only influenced by temperature and pressure, but is also strongly related to the velocity/flow rate at which the mud flows through the wellbore. Thus, the injected flow rate of drilling fluid is a variable of the rate of the shear stress in the annulus, described herein. Furthermore, the shear rate and stress are also related to variables such as, but not limited to, drillpipe rotational RPM and cuttings loading/buildup in the annulus.

As mentioned above, drilling fluid viscosity is a key factor in the amount of friction loss generated in the annulus along the entire wellbore length whenever there is fluid in motion. Any fluids (including liquid and gas) moving along a solid boundary, such as the external surface of the drillpipe or the wellbore internal walls, will impose a force on the fluid-surface boundary, referred to as shear stress/force. The magnitude of this shear stress is directly proportional to the fluid viscosity. The shear rate is the rate at which the shear stress is applied and is also governed by the fluid viscosity.

As a result, increasing the viscosity of the drilling fluid will increase the BHP and ECD by means of the increased frictional forces the fluid creates in the annulus as it flows through the system. Similarly, decreasing the viscosity of the drilling fluid will decrease the BHP and ECD. The increase/decrease in viscosity will also increase/decrease the point pressure along the entire well length, and so control of the viscosity of the drilling fluid also allows a user to control the pressure profile of the fluid in the annulus along the entire wellbore length.

The method may further comprise stopping rotation of the drillstring, pumping drilling fluid into a side port adjacent the uppermost portion of the drillstring, ceasing pumping of drilling fluid into the uppermost end of the drillstring, connecting a new section of drill pipe to the uppermost end of the drillstring, commencing pumping of drilling fluid into the uppermost end of the new section of drillpipe, ceasing pumping of drilling fluid into the side port, and recommencing rotation of the drillstring.

Previously, viscosity has been used to enhance gel strengths in drilling fluids for improving cuttings suspension and cuttings carrying capacity while drilling. Gel strength is the measure of the ability of a chemical additive to be dispersed within a drilling fluid to develop and retain a gel form. The gel strength of a drilling fluid determines its ability to hold solids in suspension. It is based on its resistance to shear force, and in this case the forces acting on the drilling fluid as it flows upwards in the annulus—such as pipe rotation, and roughness factors associated with the different materials that the fluid is in contact with (drillpipe, formation, casing etc.).

The gel strength of a drilling fluid increases over time as it remains static. As drilling progresses, it is necessary to connection new sections of drill pipe to the existing drillstring to drill deeper. Conventionally, this involves shutting down fluid circulation completely so the pipe can be connected into place as the top drive has to be disengaged and the main hose removed from the top of the drillpipe. This time over which this process takes place, is known as a connection period, and so, in conventional drilling, circulation of drilling fluid is temporarily stopped during connection periods.

During this operation, the bottom hole pressure is largely affected, decreasing in value which can lead to a multitude of events such as a kick if the BHP decreases below pore pressures, and cuttings drop out. On deeper wells undesired large variances in the drilling fluid properties are created from high bottom hole temperatures when static conditions exist.

Moreover, during this time, the drilling fluid becomes gel-like from the lack of the shear force from flow. The longer it remains static, the more force will be required to break the gel strength. The effects of temperature and pressure compound this. This will have a direct effect on the BHP when circulation is initiated, creating additional forces to overcome for breaking the gel strengths before drilling fluid re-commences flowing in the annulus. This will be reflected as a large increase in the BHP and is an undesired effect in drilling operations. Therefore, these effects are pronounced after connection periods when, conventionally, circulation is ceased. These can be mitigated by a continuous circulating method.

A method, referred to as continuous circulation, has been developed to achieve constant circulation through a side bore in the pipe at surface before the top drive is disengaged for a connection. Circulation continues unimpeded via a special side bore that is integrated into the pipe, allowing for the drilling fluid to be circulated through this bore while the main hose is removed from the top of the drillstring and a new pipe is installed. The top drive is re-engaged to the top of the new section of pipe, and, once the connection is complete, the circulation recommences down the main bore of the drillpipe. Circulation at the side bore then ceases and the side bore is closed with a plug. A description of this specific design of continuous circulation drilling is disclosed in U.S. Pat. No. 2,158,356, for example. Regardless of the design, continuous circulation counteracts the negative effects on BHP associated with connections, and therefore it is a critical process for managing and controlling BHP.

By using the method according to the invention in a continuous circulation drilling system, a new section of pipe can be added to the drillstring without having to break the gel strength of the drilling fluid and so these undesirable increases in BHP can be avoided.

In an embodiment of the invention, the method further comprises varying the rate of flow of drilling fluid into the uppermost end of the drillstring.

The shear stress/force and shear rate are also directly proportional to the fluid velocity. Increasing the flow rate Q increases the fluid velocity which results in higher shear rates in the annulus and thus higher friction losses. Similarly, decreasing the flow rate Q decreases the fluid velocity and this results in lower shear rates in the annulus and thus lower friction losses. As a result, increasing the flow rate Q increases the BHP and ECD, and decreasing the flow rate Q decreases the BHP and ECD.

In an embodiment of the invention, the method further comprises varying the speed of rotation of the drillstring.

It has recently been proven that the rotational speed of the drillstring has an effect on the BHP. As the rotational speed of the drillstring decreases, the BHP decreases and vice versa. Drillstring rotation generates an additional axial component to the shear force/stress of fluid flow in the annulus, and this results in additional frictional losses which contribute to the BHP. As the rotational speed of the drillstring increases, the frictional forces, and hence the BHP increases. Similarly, as the rotational speed of the drillstring decreases, the frictional forces, and hence the BHP decreases.

In an embodiment of the invention, the method comprises reducing the speed of rotation of the drillstring when preparing to connect a new section of drill pipe to the uppermost end of the drillstring, and simultaneously increasing the rate of flow of drilling fluid into the drillstring. Similarly, the method may comprise increasing the speed of rotation of the drillstring after having connected a new section of drill pipe to the drillstring, and simultaneously decreasing the rate of flow of drilling fluid into the drillstring.

As the rotational speed of the drill string is decreased the BHP will decrease, and therefore the fluid flow rate is used to counteract this effect by increasing the pump speed. The relationship between pump rate Q and rotation RPM is explained in U.S. provisional patent application 61/41428.

In one embodiment of the invention, the method comprises altering the BHP by operating an adjustable choke in a flow line through which drilling fluid leaves the borehole.

In one embodiment of the invention, step f of the method comprises adding chemical additives to the drilling fluid to alter its viscosity, which will be used as the primary component for controlling the BHP and the pressure/ECD profile along the entire well length.

Preferably the additional of the chemical additives does not substantially alter the density of the drilling fluid.

DESCRIPTION OF THE DRAWINGS

Embodiments of the invention will now be described, by way of example only, with reference to the following drawings of which.

DESCRIPTION OF THE PREFERRED EMBODIMENTS

Figure 1:
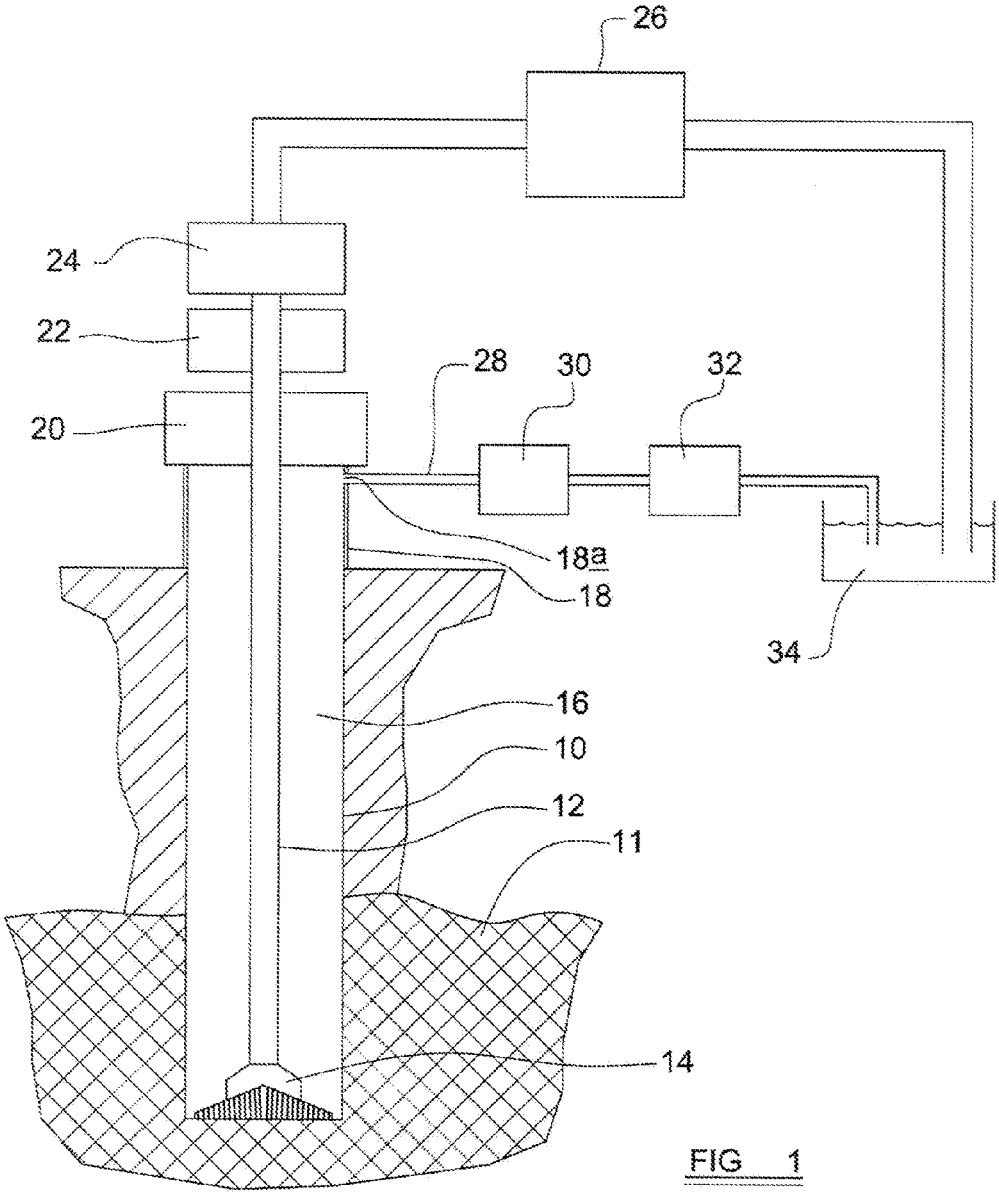
FIG. 1 is a schematic illustration of a drilling system suitable for use in a method in accordance with the invention.

Referring now to FIG. 1, this shows a schematic illustration of a land-based system for drilling a subterranean borehole. It should be appreciated, however, that the invention may equally be used in relation to an off-shore drilling system. This figure shows a borehole 10 which extends into a geological formation 11 comprising a reservoir of fluid such as oil, gas or water. A drill string 12 extends down into the bore hole 10. At the lowermost end of the drill string 12 there is a bottom hole assembly (BHA) 14 comprising a drill bit, a bottom hole motor, various sensors, and telecommunications equipment for transmitting readings from the sensors to surface monitoring and control equipment. The uppermost end of the drill string 12 extends to a drilling rig (not shown for clarity).

In this example, the borehole 10 is capped with a well head 18, and a closure device 20 such as a rotating blow out preventer (BOP) or rotating control device (RCD). The invention may equally be used with an open system that does not contain a capped wellbore or closure device, however, as will be discussed further below. The drill string 12 extends through the well head 18 and closure device 20, the closure device 20 having seals closure around the exterior of the drill string 12 to provide a substantially fluid tight seal around the drill string 12 whilst allowing the drill string to rotate about its longitudinal axis, and to be moved further down into and out of the borehole 10. Together, the well head 18 and closure device 20 contain the fluid in the annulus 16.

In this example, the drill string 12 extends from the closure device 20 to a driving apparatus 22 such as a top drive, and the uppermost end of the drill string 12 is connected to the outlet port of a standpipe manifold 24 which has an inlet port connected by an inlet line to a pump 26. The wellhead 18 includes a side port 18*a* which is connected to an annulus return line 28, and which provides an outlet for fluid from the annulus 16. The annulus return line extends to a reservoir 34 of drilling fluid via an adjustable choke or valve 30 and a flow meter (such as a Coriolis flow meter) which is downstream of the choke/valve 30. Filters and/or shakers (not shown) are generally provided to remove particulate matter such as drill cuttings from the drilling fluid prior to its return to the reservoir 34.

During drilling, the driving apparatus 22 rotates the drill string 12 about its longitudinal axis so that the drill bit cuts into the formation, and the pump 26 is operated to pump drilling fluid from the reservoir 34 to the standpipe manifold 24 and into the drill string 12 where it flows into the annulus 16 via the BHA 14. The mud and drill cuttings flow up the annulus 16 to the well head 18, and into the annulus return line 28, and the adjustable choke or valve 30 may be operated to restrict flow of the drilling fluid along the annulus return line 28, and, therefore, to apply a back-pressure is applied to the annulus 16. This back-pressure may be increased until the fluid pressure at the bottom of the wellbore 10 (the bottom hole pressure) is deemed sufficient to contain the formation fluids in the formation 11 whilst minimising the risk of fracturing the formation or causing drilling fluid to penetrate the formation. The rate of flow of fluid out of the annulus 16 is monitored using the flow meter 32, and compared with the rate of fluid into the drill string 12, and this data may be used to detect a kick or loss of drilling fluid to the formation.

Such a system is, for example, disclosed in U.S. Pat. No. 6,575,244, and U.S. Pat. No. 7,044,237.

Figure 2:
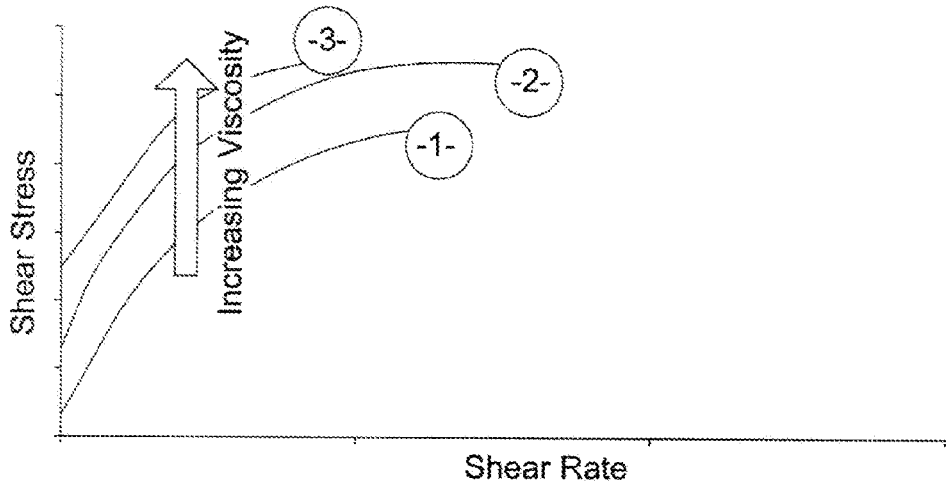
FIG. 2 is a graph illustrating the relationship between the shear stress and shear rate for different fluid viscosities.

Turning now to FIG. 2, this is an example of a graphical representation of viscosity and its shear stress and shear rate relationship is shown. In this example, each curve is a fluid with a given viscosity. The first fluid (1) has the lowest viscosity and fluid 3 has the highest viscosity.

The initial plot points for each curve on the vertical axis are the yield points, representing the minimum forces required for each of the fluids to commence flowing. Therefore, when operation of the pump 26 is stopped and then re-commenced, this is the force that must be overcome to initiate flow of drilling fluid down the drillstring and up the annulus. As the value of viscosity increases, the yield point of the fluid will increase.

The horizontal axis is the rate of shear which is directly proportional to the rate at which drilling fluid is pumped by the pump 26 into the drilling string and back up the annulus (hereinafter referred to as the pump rate Q)—as the velocity of the fluid increases from increased pump rate Q, the shear stress and shear rate rises. The shear stress is related to the increasing magnitude of frictional losses generated in the annulus while fluids 1, 2, or 3 flow up the annulus at different flow rates. As this flow rate increases, shear rate and shear stress increases indicated by the curve.

Therefore, as viscosity is varied from a low value (1) to a higher value (3) in a drilling fluid system, the frictional losses in the annulus rise due to increased resistance to flow. The compounding effects of the pressure losses along the entire wellbore length will be used to control the pressure at the bottom of the well (BHP).

The method according to the invention uses this relationship between viscosity and frictional losses in selecting the optimal viscosity for the drilling fluid system to control the ECD, and ultimately the BHP. For a single flow rate and density, Fluid 1 with the lowest viscosity would expect to have the lowest BHP due to its lower shear stress which would result in lower friction losses in the annulus. Fluid 3 with the highest viscosity would expect to have the highest BHP due to its high shear stress which would result in higher friction losses in the annulus.

The method according to the invention therefore includes the following steps:

a) determining the drilling fluid flow rate range required to achieve effective removal of cuttings and any other solid debris from the wellbore, bearing in mind the power requirements of the downhole motor (where a downhole motor is provided);
b) determining the upper and lower BHP limits;
c) determining the viscosity of drilling fluid which will maintain the BHP within the range set by the upper and lower BHP limits over the entire or the majority of the required drilling flow rate range;
d) adjusting the composition of a drilling fluid to bring the drilling fluid to the viscosity calculated in step c above prior to pumping the drilling fluid into the drillstring 12.

The upper and lower BHP limits are determined by the pore pressure and fracture pressure of the formation 11, and may be calculated using methods which are well known to persons of skill in the art, on the basis of information about the nature and structure of the formation 11 derived from geological surveys.

Whilst the method according to the invention is advantageously carried out prior to drilling, it may additionally/alternatively be carried out during drilling, since the upper and lower BHP limits will commonly vary as drilling progresses.

The effective viscosity is the actual viscosity of the fluid at the given shear rate which exists in the circulating system at a specific density and pump rate. The invention will use this data for modelling that will be performed during drilling when a fluid viscosity change is required. The invention will use a hydraulics model for accurately predicting the change in the friction losses along the wellbore length and the resultant effect on BHP before viscosity is changed in real time during drilling operations.

The viscosity of the drilling fluid may be changed by adding chemical additives to the drilling fluid in the reservoir 34 as drilling progresses. Preferably, the additives used to alter the viscosity of the drilling fluid do not affect its density. If the additives used for control of the viscosity of the drilling fluid also increase the weight/density of the drilling fluid, then this introduces an additional variable which will also directly affect BHP. In order to solely control the BHP with viscosity, it is necessary to use additives that will have negligible effects on the density/weight of the system. Additionally, as discussed above, the viscosity affects the entire pressure profile along the well length from the frictional losses viscosity creates at each point along the well—density is more for a "point" control of pressure using principles of hydrostatic pressure (static/no flow conditions where the weight/density of the fluid prevents formation influx) and equivalent circulating density (when the pumps are operating and fluid is flowing the weight/density of the fluid plus friction losses in the annulus have a compound effect to prevent formation influx).

The additives may comprise viscosifiers that are available in liquid or solid form. Generally, if you mix/disperse a solid into a fluid you increase the solids/particle concentration of the mixture, and this will increase its density. Conventionally, drilling fluids (muds) are weighted up/increased in density by adding barite which is a heavier solids particle that is dispersed into the mud system. A viscosifier additive that exists as a liquid in a 5 gallon pail/bucket should have a much less effect on the density of the overall drilling fluid system, as they are much more easily dispersed and contain less solids particles in their chemical composition.

Certain solid viscosifiers require much smaller concentrations than other solid viscosifiers to achieve the same viscosity value in a drilling fluid system. Examples of solid viscosifiers are Xantham Gum, Bentonite, or Hydroxyethylcellulose (referred to as HEC). For example, an average concentration for Bentonite is 20-25 lbs/bbl, whereas Xantham can be added at 1 lb/bbl to achieve similar viscosity values. It would be expected that the density of the system that uses Bentonite would be affected on a much larger scale than the system which uses Xantham due to the high concentration required, and therefore it would be preferred to use Xantham with the inventive method to achieve the desired viscosity.

Alternatively, a second reservoir of drilling fluid may be provided, and when it is determined that a change in the viscosity of the drilling fluid is required, the composition of the drilling fluid in the second reservoir may be adjusted to bring it to the new viscosity. The pump 26 may then be operated to draw drilling fluid from the second reservoir instead of the original reservoir 34, or an alternative pump may be operated instead of the original pump 26 to pump drilling fluid from the second reservoir into the drillstring 12. This process may be repeated with additional drilling fluid reservoirs when further viscosity changes are required.

The effective viscosity is the actual viscosity of the fluid at the given shear rate which exists in the circulating system at a specific density and pump rate. The effective viscosity of the drilling fluid may be monitored during drilling using a conventional viscosity meter (such as fan meter) which may be positioned in the bottom hole assembly or at any other point in the drillstring 12 or annulus 16. The viscosity meter may be connected to a central control unit which displays the current effective viscosity reading to allow an operator to compare this with the desired viscosity, or, more preferably, is programmed to compare the effective viscosity with the desired viscosity, and issue a warning to an operator when the difference between the two exceeds a predetermined threshold. An operator may then make further changes to the composition of the drilling fluid to bring it to, or least closer to, the desired viscosity.

The measured effective viscosity may be used in a hydraulics model to accurately predict the change in the friction losses along the wellbore length and the resultant effect on BHP before viscosity is changed in real time during drilling operations.

Figure 3:
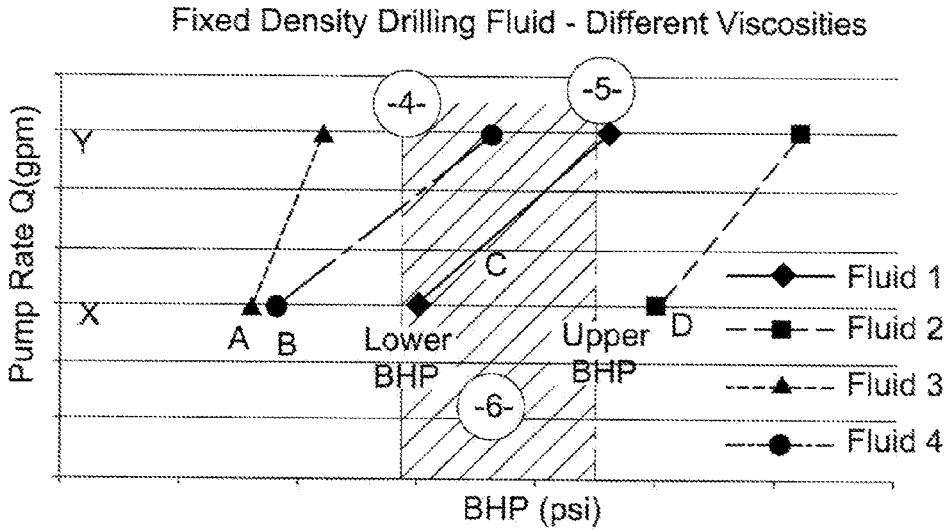
FIG. 3 is a graph showing the viscosity-pressure relationship utilized for viscosity selection of a drilling fluid system operated in accordance with the invention.

Turning now to FIG. 3, this illustrates, by way of example, the evaluation of four different viscosities for a single fluid at a fixed density for drilling. The upper (5) and lower (4) pressure limits for drilling are shown, resulting in the BHP operating envelope (6). It will be appreciated that a minimum flow rate of drilling fluid will be required for effective removal of cuttings and other solid debris from the well bore. Moreover, where a downhole motor is provided, a minimum flow rate of drilling fluid is required to operate the downhole motor. The upper flow rate may be determined by various factors such as the maximum safe operating speed of the pump 26, the maximum permitted speed of operation of the downhole motor.

Each fluid is evaluated over a flow rate of X to Y, which is the anticipated range for drilling the section of the wellbore to meet the power requirements for the down hole motor and effectively clean the wellbore of solids. Fluid 3 with viscosity C falls within the operating pressure margin for the required flow rate range, and is deemed the optimal viscosity to use in this section as it meets the desired target BHP.

Fluid 1 with viscosity A falls below the lower limit for the target BHP, and fluid 4 with viscosity D exceeds the upper limit for BHP. Fluid 2 with viscosity B has flow rates which will meet the BHP criteria, but cannot provide the range of flow rates desired for the section.

FIG. 3 shows the same relationship between viscosity and Q that is exhibited in FIG. 2—as the flow rate is increased from X, velocity of the fluid increases in the annulus. This creates more friction from the shear stresses present, and as the velocity of flow rises from increased pump rate Q, the shear rate or the rate of which the shear stress is applied increases. The amount of shear forces present increases with the viscosity value of the fluid. This relationship is proportional, and thus friction loss in the annulus continues to increase with increases in pump rate and viscosity.

Figure 4:
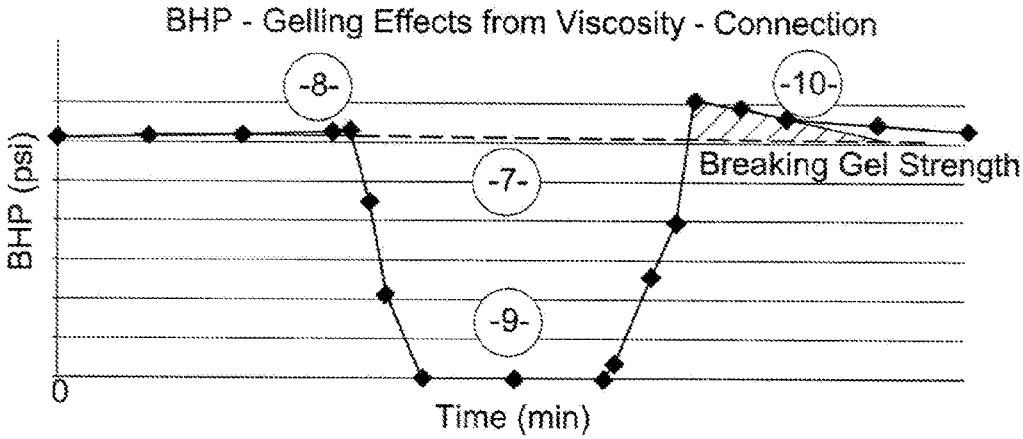
FIG. 4 is a graph illustrating the importance of combining the inventive method and continuous circulation.

Turning now to FIG. 4, this illustrates the drilling fluid behaviour during a period of non-circulation—for example during a connection period without a continuous circulation method in place. The target drilling BHP is represented by the horizontal dotted line (7). The circulating BHP starts to rise (8) before the pump rate is ceased due to cuttings that are in the annulus from drilling. At time $t_0$, the pumps are stopped.

Once the pumps are shut down, fluid velocity and fluid rate in the annulus reaches zero as circulation stops (9). During the time period that the pumps are off for the connection, the drilling fluid begins to gel. This gel strength is related to the viscosity of the fluid—in general the more viscous the fluid the higher the gel strength the fluid will have.

The lack of shear from no circulation in the annulus allows the fluid to gel or stiffen. Once the connection is complete the pumps are started at time $t_1$ to re-commence circulation, and the inertia of the circulating drilling fluid must overcome these additional frictional forces present from the drilling fluid gel strength in addition to the frictional forces already present. The target BHP is exceeded while these friction losses are overcome in the annulus to break the gel strength (10), until at $t_2$, the BHP reaches a maximum, before gradually falling to the desired level.

This illustrates the importance of using the method with a continuous circulation method described herein. As viscosity is the primary mechanism for the method to control BHP, higher viscosities will yield higher gel strengths to be overcome after periods of non-circulation. Therefore it is preferable that the inventive method is used in a drilling system which allows for continuous circulation.

Figure 5:
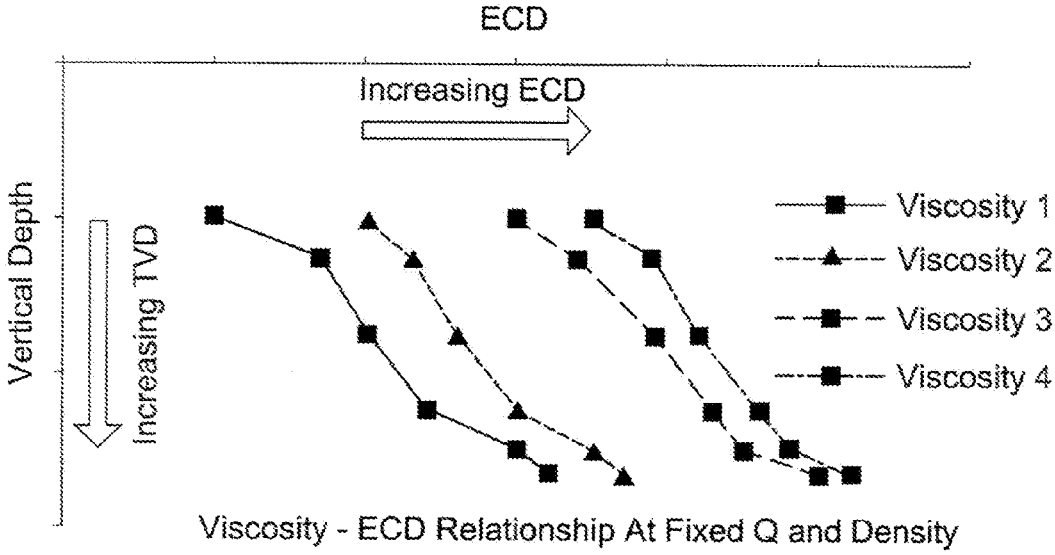
FIG. 5 is a graph illustrating the relationship between the viscosity and the ECD along the wellbore length for a fixed flow rate and density.

Turning now to FIG. 5, this illustrates the relationship between viscosity and BHP control expressed as a function of the ECD along the wellbore length. The graph represents a fluid at a fixed density and flow rate at 4 different viscosities as a function of ECD and well length/depth. The ECD magnitude increases with depth as friction losses increase with depth. As the viscosity of the fluid is increased, each curve shifts to the right indicating increased friction losses in the annulus from increased shear stresses. The ECD shows the pressure control achieved at any point along the length of the wellbore by varying the viscosity.

Figure 6:
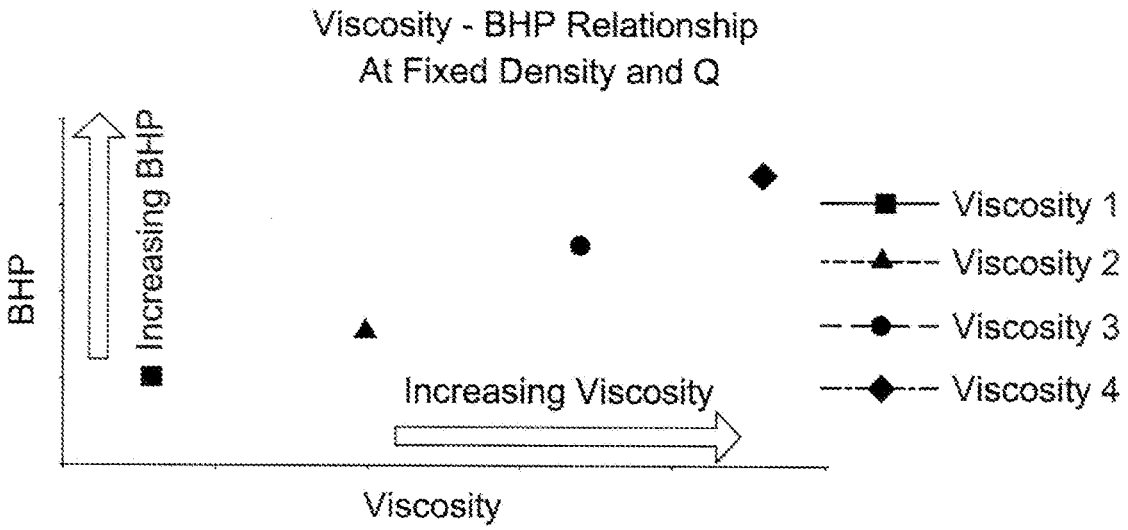
FIG. 6 is a graph illustrating the effect of varying the viscosity on the BHP for a fixed flow rate and density.

Turning now to FIG. 6, this illustrates the relationship between viscosity and pressure control expressed as a function of the BHP at the bottom of the well. The graph represents a fluid at a fixed density and flow rate at 4 different viscosities. As the viscosity increases, the points shift to the right and the BHP value increases. The increased shear stresses imposed in the annulus from increasing viscosity ultimately increases the total friction loss in the annulus and will increase the value of the BHP as a result.

As mentioned above, the shear stress/force and shear rate are also directly proportional to the fluid velocity. Increasing the flow rate increases the fluid velocity which results in higher shear rates in the annulus and thus higher friction losses. Similarly, decreasing the flow rate decreases the fluid velocity and this results in lower shear rates in the annulus and thus lower friction losses. As a result, increasing the flow rate increases the BHP and ECD, and decreasing the flow rate decreases the BHP and ECD. The flow rate is, of course, controlled by the Q, and therefore the speed of operation of the pump 26 can be used as further means of controlling the BHP. The BHP can be increased by increasing the speed of operation of the pump 26 or decreased by decreasing the speed of operation of the pump 26.

Moreover, during drilling, drillstring rotation generates an additional axial component to the shear forces acting on fluid flow in the annulus. This results in additional frictional losses which also effects the BHP and ECD. As a result, in addition to using the viscosity of the drilling fluid to control the BHP, further control may be provided by controlling the speed of rotation of the drillstring (RPM). As set out in our co-pending U.S. provisional patent application 61/41428 (the contents of which is incorporated by reference herein), it has been found that increasing the RPM increases the BHP, whilst decreasing the RPM decreases the BHP. Thus, control of the RPM provides an additional means of control of the BHP in addition to the control of the drilling fluid viscosity and pump speed.

During connection periods, rotation of the drillstring 12 is stopped to allow a new section of drill pipe to be secured to the top of the drillstring 12. As disclosed in U.S. 61/41428, as the RPM is reduced in preparation for making a connection, the speed of operation of the pump 26 may be increased to increase Q. In this way, the drop in BHP arising from the reduction in RPM can be counteracted by an increase in BHP arising from the increase in Q. Similarly, as the RPM is increased after the connection process is completed, the pump speed may be correspondingly reduced. In this way, the increase in BHP arising from the increase in RPM can be counteracted by a decrease in BHP arising from the decrease in Q.

Of course, the invention has been described in relation to a drilling system in which control of the BHP can be achieved by operation of the adjustable choke valve 30 as in conventional managed pressure drilling systems, and as described above. This control can be used in addition to the other methods of BHP control described above.

It should be appreciated that, although the invention has been described above for use in conjunction with a closed loop drilling system, it could equally be used in conjunction with an open system, in which there is no containment of the fluid pressure in the annulus, and no provision for additional control of the BHP using a back-pressure choke valve.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A method of drilling a subterranean borehole comprising:

a) pumping a drilling fluid down a drillstring, the drillstring having a bit at an end thereof, b) rotating the drillstring about a longitudinal axis of the drillstring so that the bit forms a wellbore in a ground, the method further comprising the steps of:

c) determining a desired drilling fluid flow rate range;

d) determining a desired upper and lower limits of a fluid pressure at a bottom of the wellbore (the BHP);

e) determining a viscosity of drilling fluid which will maintain the BHP within a range set by the upper and lower BHP limits over the entire or a majority of the desired drilling flow rate range;

f) adjusting a composition of a drilling fluid to bring the drilling fluid to the viscosity calculated in step e above.

2. The method of claim 1 wherein steps c, d, e and f are carried out prior to steps a and b.

3. The method of claim 1 wherein the desired drilling fluid flow rate range is determined by establishing a flow rate required to achieve effective removal of cuttings and any other solid debris from the wellbore.

4. The method of claim 1 wherein the drillstring is provided with a fluid operated motor which is operable to cause rotation of the bit, and a minimum fluid flow rate to operate the motor and/or a maximum flow rate tolerated by the motor is considered when determining the desired drilling fluid flow rate range.

5. The method according to claim 1 further comprising stopping rotation of the drillstring, pumping drilling fluid into a side port adjacent an uppermost portion of the drillstring, ceasing pumping of drilling fluid into an uppermost end of the drillstring, connecting a new section of drill pipe to the uppermost end of the drillstring, commencing pumping of drilling fluid into an uppermost end of the new section of drillpipe, ceasing pumping of drilling fluid into the side port, and recommencing rotation of the drillstring.

6. The method of to claim 1 the method further comprising varying a rate of flow of drilling fluid into an uppermost end of the drillstring.

7. The method of to claim 1, the method further comprising varying a speed of rotation of the drillstring.

8. The method of to claim 1 wherein the method further comprises reducing a speed of rotation of the drillstring when preparing to connect a new section of drill pipe to an uppermost end of the drillstring, and simultaneously increasing a rate of flow of drilling fluid into the drillstring.

9. The method of claim 1 wherein the method further comprises increasing a speed of rotation of the drillstring after having connected a new section of drill pipe to the drillstring, and simultaneously decreasing a rate of flow of drilling fluid into the drillstring.

10. The method according to claim 1 wherein the method further comprises altering the BHP by operating an adjustable choke in a flow line through which drilling fluid leaves the wellbore.

11. The method according to claim 1 wherein step f of the method comprises adding chemical additives to the drilling fluid to alter the viscosity of the drilling fluid.

12. The method according to claim 11 wherein the addition of the chemical additives does not substantially alter a density of the drilling fluid.

* * * * *